US005235709A

United States Patent [19]

Terlep

[11] Patent Number: 5,235,709

[45] Date of Patent: Aug. 17, 1993

[54] PERMANENT WAVE RINSE BAG

[76] Inventor: Timothy A. Terlep, 2115 Grant St., Elkhart, Ind. 46514

[21] Appl. No.: 718,011

[22] Filed: Jun. 20, 1991

[51] Int. Cl.[5] ..... A45D 19/14

[52] U.S. Cl. ..... 4/515; 4/518

[58] Field of Search ..... 4/515, 516, 517, 518, 4/519, 520, 521, 522, 523; 132/212, 270; 604/305; 128/368, 370, 400

[56] References Cited

U.S. PATENT DOCUMENTS

| | | | |
|---|---|---|---|
| 379,646 | 3/1888 | Heinemann | 4/515 |
| 998,803 | 7/1911 | Salisbury . | |
| 998,804 | 7/1911 | Salisbury . | |
| 1,612,602 | 12/1926 | Bowman . | |
| 1,769,186 | 7/1930 | Morris | 132/212 X |
| 2,600,557 | 6/1952 | Marriott | 4/521 X |
| 2,812,519 | 11/1957 | Parks | 4/518 |
| 3,040,336 | 6/1962 | Plank . | |
| 3,177,868 | 4/1965 | Wallace et al. | 4/517 X |
| 3,456,655 | 7/1969 | Hale | 132/212 |
| 4,172,495 | 10/1979 | Zebuhr et al. | 128/400 X |
| 4,605,017 | 8/1986 | Thompson et al. . | |
| 4,817,218 | 4/1989 | Dimitriu et al. . | |
| 4,987,618 | 1/1991 | Tolbert | 4/515 |
| 5,075,908 | 12/1991 | Newman | 4/516 X |
| 5,099,865 | 3/1992 | Flannery et al. | 4/516 X |

FOREIGN PATENT DOCUMENTS

| | | | |
|---|---|---|---|
| 0528292 | 6/1931 | Fed. Rep. of Germany | 4/517 |
| 7503827 | 10/1976 | Netherlands | 132/212 |
| 0016875 | of 1897 | United Kingdom | 4/518 |

*Primary Examiner*—William A. Cuchlinski, Jr.
*Assistant Examiner*—John L. Beres
*Attorney, Agent, or Firm*—Price Heneveld Cooper DeWitt & Litton

[57] ABSTRACT

A permanent wave rinse bag having a membrane for containing and directing rinsing fluid, having a network of conduits embedded in the membrane for distributing and dispensing rinsing fluid to a user's hair. An inlet conduit is connected with the distribution conduits and extends away from the rinse bag for convenient connection with a wash basin faucet or other source of rinsing fluid. A series of apertures are provided along the distribution conduits, on the interior side of the rinse bag, for dispensing rinsing fluid from the conduits to the hair. A drain aperture is also provided in the rinse bag for conduction rinsing fluid, collected within the membrane out of the rinse bag. A drawstring or elastic closure is provided around the perimeter of the bag to hold the bag close to the user's face and minimize seepage past the perimeter of the bag.

13 Claims, 2 Drawing Sheets

PERMANENT WAVE RINSE BAG

BACKGROUND OF THE INVENTION

The present invention pertains to devices used in hair styling and in particular to devices for rinsing permanent wave treated hair.

Both men and women commonly style their hair with a permanent wave treatment. When a person's hair is to be treated with a permanent wave, such treatment typically involves sectioning the person's freshly shaped and shampooed hair into strands, wrapping each strand around a curling rod, and applying a waving solution to the wrapped strands. Conversely, the waving solution may be applied to the hair prior to sectioning and wrapping the hair strands around the curling rods. In either event, the waving solution remains on the hair to treat the hair for a predetermined time, according to the solution manufacture's recommendation. After the treatment period has expired, the waving solution is thoroughly rinsed from the hair. This is most commonly accomplished by tilting the person's head back in a sink basin, and repeatedly drenching the hair with water, commonly dispensed from a sprayer hose. This permanent rinsing will require approximately one quarter of an hour to complete, on the average, and require extended periods of time with longer hair lengths. After the permanent solution is thoroughly rinsed from the hair, a towel is used to blot excess moisture from the hair.

A neutralizing solution will typically be applied to the wrapped hair and allowed a predetermined time period to neutralize the reaction of the permanent wave solution with the hair. After neutralizing, another rinsing and blotting procedure is typically required to remove the neutralizer and excess rinse moisture. Finally, the hair strands are unwound and the permanent wave treated hair is styled.

Since each of the above described rinsing procedures can easily require in excess of a quarter of an hour to accomplish, it is quite desirable to minimize the need for a salon operator to expend such time manually rinsing a person's hair. The rinsing procedure is quite critical in terms of the health of the hair, because it minimizes potential damage which can result by excessive treatment with waving solution which was not thoroughly rinsed from the hair. The wave imparted to the hair by the permanent waving process can also be destabilized and prematurely dissipate because of an incomplete rinsing.

Therefore, the need for an effective and thorough rinsing of a permanent wave treatment is readily apparent.

SUMMARY OF THE INVENTION

The present invention addresses the above problems in thoroughly rinsing a permanent wave solution from treated hair by providing a rinsing device which covers the hair of a person receiving a permanent wave treatment and which has interconnected conduits for conducting a rinsing fluid to the hair, flooding the hair with the rinsing fluid, and flushing the permanent wave solution from the hair. The rinsing device of the present invention has a perimeter edge with a closure for holding the edge closely adjacent the user's head to minimize mess caused by seepage or splashing of rinse fluid past the perimeter of the device.

In one aspect of the invention, a rinse fluid inlet tube is provided for convenient connection with a common wash basin sprayer hose or the like. In another aspect, a generally centrally located drain opening is provided to further minimize mess caused by splashing of rinse fluid.

These and other objects, advantages and features of the present invention will become apparent upon review of the following specification in conjunction with the drawings.

DESCRIPTION OF THE PREFERRED EMBODIMENT

Figure 1:
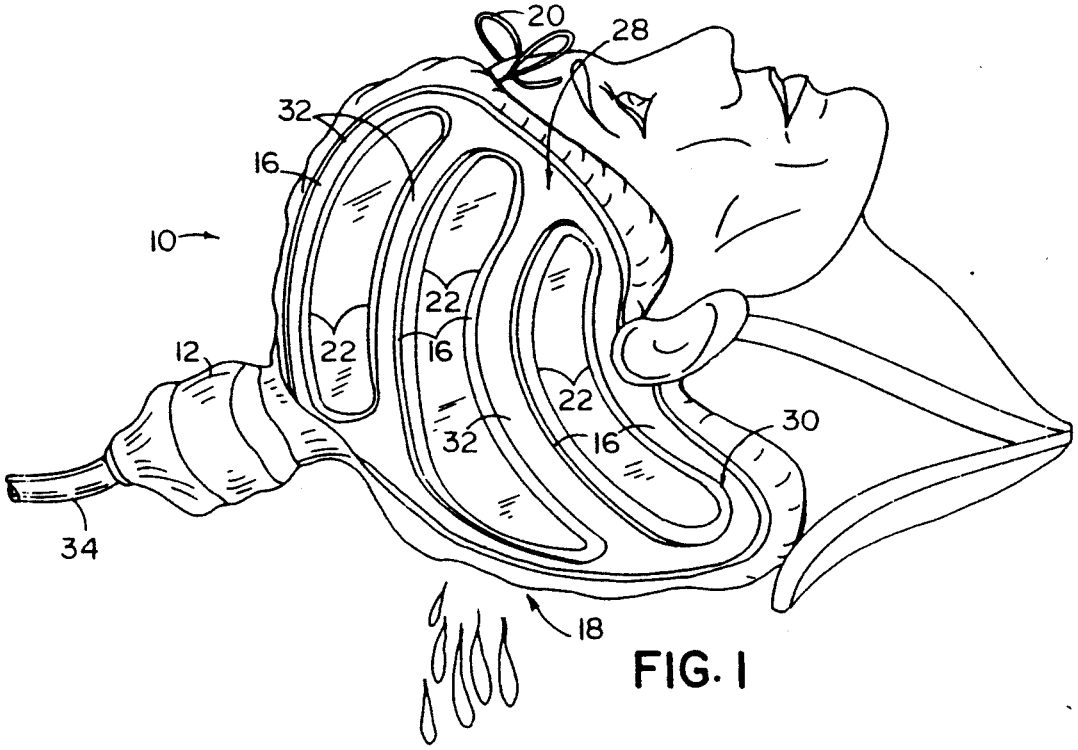
FIG. 1 is a side elevational view of a rinsing device according to the present invention as it would be used on a person's head.
Figure 2:
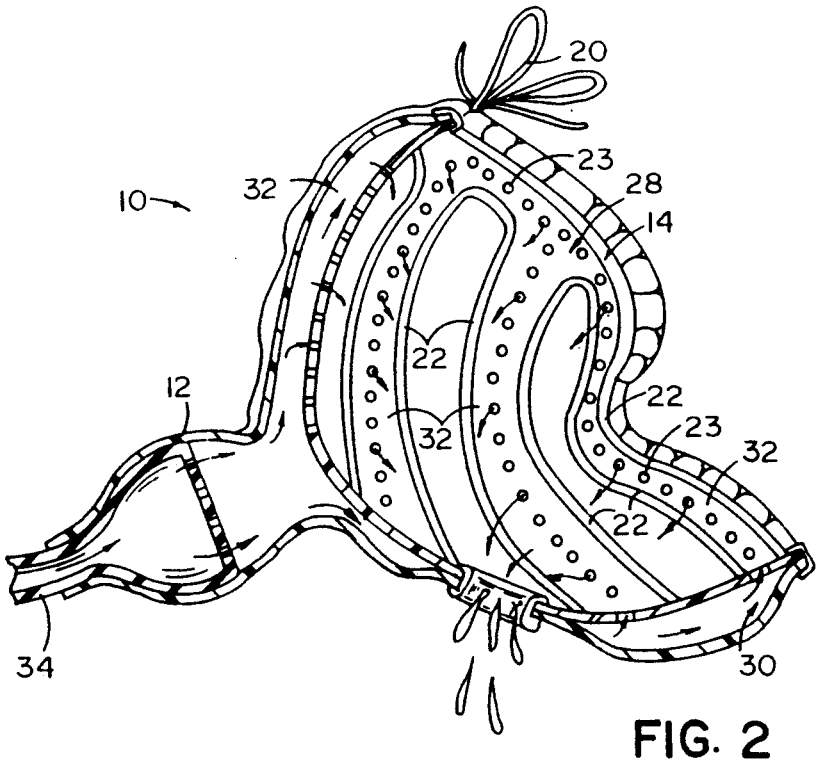
FIG. 2 is a center line sectional view of the device of FIG. 1.
Figure 3:
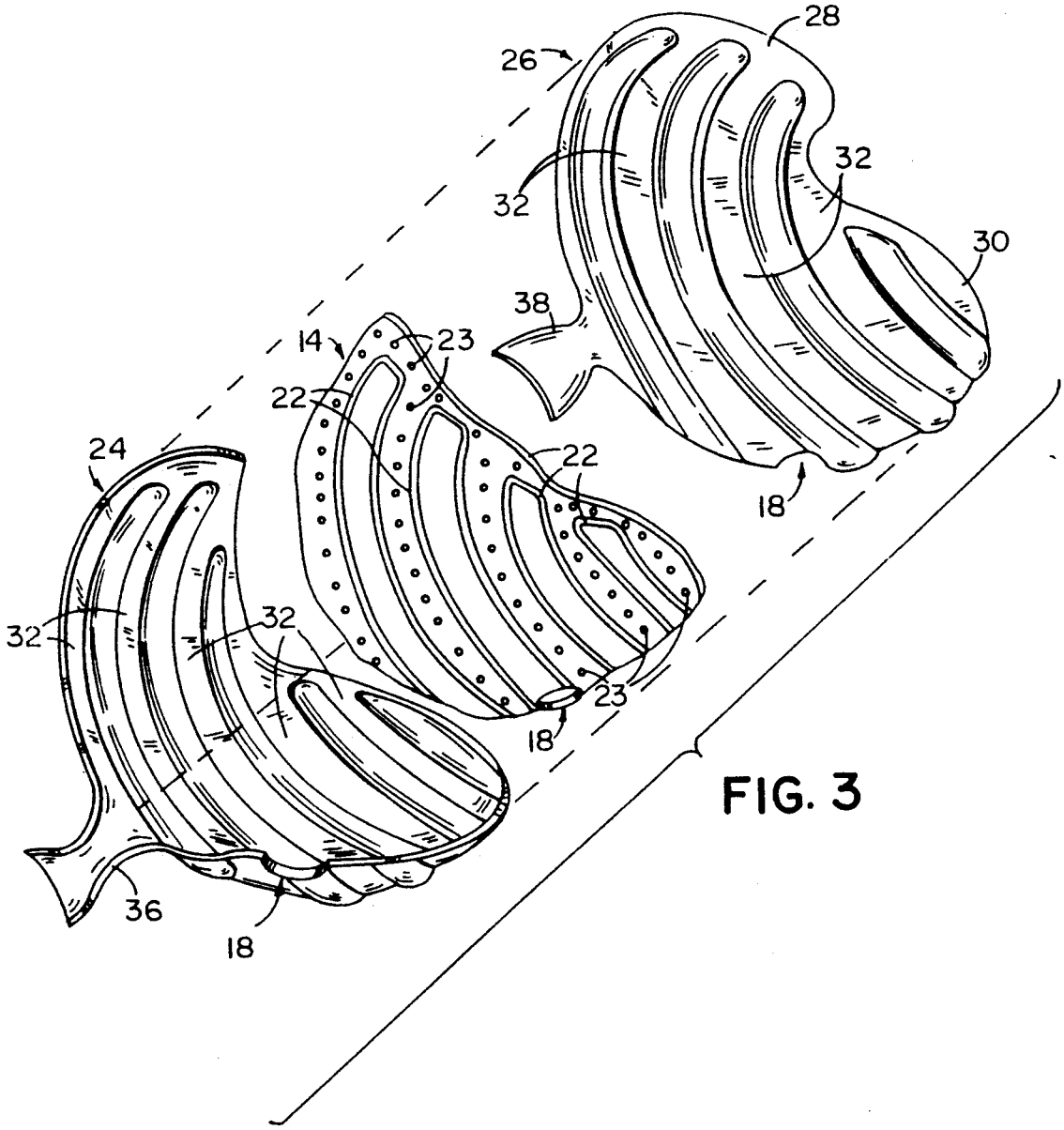
FIG. 3 is an exploded perspective view of the device of FIG. 1.

A permanent wave rinse bag 10 according to the present invention is shown in FIGS. 1–3. Rinse bag 10 comprises an inlet conduit 12, a first or inner membrane 14, distribution conduits 16 and a drain opening 18.

Inner membrane 14 provides a water tight barrier for containing the dispersal of rinsing fluid in the vicinity of the user's hair. The perimeter of inner membrane 14 is held closely adjacent a user's face and neck by a perimeter drawstring 20. Drawstring 20 may be a nonelastic member which is drawn tight and tied off as is commonly known (FIGS. 1 and 2). Also, drawstring 20 may be an elastic loop which will stretch for application over the user's head, also commonly known.

Distribution conduits 16 are preferably formed by overlaying a second or outer membrane on the first membrane 14 and selectively sealing the two membranes together to form a series of borders 22, defining the distribution conduits 16. A series of apertures 23 is defined in first membrane 14, along each distribution conduit 16, for dispensing rinsing fluid from the conduit to the user's hair (FIGS. 2 and 3).

The second membrane is preferably formed from two pieces 24 and 26 (FIG. 3). Each of the two membrane pieces 24, 26 overlays and is selectively sealed to an opposing half of membrane 14, forming conduits 16 as discussed above. Each of the two membrane pieces 24, 26 and first membrane 14 are preferably formed from a heat sealable plastic sheet material for ease of manufacturer. In practice, the permanent wave rinse bag 10 may be made of a lightweight plastic sheeting material and be suitable for disposal after a single use. Such a construction would lend itself to inexpensively packing a permanent wave rinse bag 10 with single use portions of permanent wave treatment solution. Such a lightweight and disposable permanent wave rinse bag will preclude any healthcare concerns in a salon setting since such a disposable bag will be used only one time and with one client before being thrown away. Conversely, the permanent wave rinse bag 10 may be fabricated from a heavier weight and more durable material which might be more attractive to and appropriate for a home use market.

For optimal distribution of rinsing fluid, the distribution conduits 16 preferably include a perimeter conduit having a front portion 28 which partially circumscribes the user's face and a rear portion 30 which extends from one side of the user's face, away from the face and around the back of the head to the other side of the user's face (FIGS. 1–3). Distribution conduits 16 further preferably include a series of connecting conduits 32 which generally extend and interconnect between front portion 28 and rear portion 30 of the perimeter conduit.

The inlet conduit 12 is generally centered on rinse bag 10, interconnects with distribution conduits 16 and extends away from the user for connection with a rinsing fluid supply such as a sprayer hose 34, commonly found in hair styling salons. Each of the two membrane pieces 24, 26 has corresponding portions 36 and 38 which are sealed together along their edges to form inlet conduit 12 (FIG. 3).

In use, rinse bag 10 is used to flush a person's hair with water or other rinsing fluid. Rinse bag 10 is positioned over the user's hair and inlet conduit 12 is connected to a rinsing fluid supply, such as a sprayer hose 34 or a faucet for example. The user's head is positioned over a sink basin or other suitable receptacle and the rinsing fluid supply is opened, allowing rinsing fluid to flow through inlet conduit 12, distribution conduits 16, and apertures 23. The rinsing fluid is dispensed from apertures 23 onto the user's hair, saturating and flushing the hair. Rinsing fluid flows from the saturated hair and is contained and directed by inner membrane 14 to drain 18, where the rinsing fluid leaves rinse bag 10 and flows into the sink basin. Drawstring 20 holds the perimeter of inner membrane 14 closely adjacent the user's face and neck.

The above description is considered that of a preferred embodiment only. Modifications of the invention will occur to those who make or use the invention. Therefore, it is understood that the embodiment shown in the drawings and described above is merely for illustrative purposes and is not intended to limit the scope of the invention, which is defined by the following claims as interpreted according to the principles of patent law.

The embodiments of the invention in which an exclusive property or privilege is claimed are defined as follows:

1. A device for rinsing hair comprising:

a membrane for encompassing the hair covered portion of a user's head, said membrane having a perimeter edge;

conduit means embedded in said membrane for conducting a rinsing fluid to the user's hair; said conduit means including an inlet conduit, said inlet conduit extending from an exterior side of the device, said inlet conduit having a terminal end away from said exterior side, and said inlet conduit being adapted for operatively connecting with a faucet for supplying the rinsing fluid to the device; said conduit means including a perimeter conduit adjacent said perimeter edge, said perimeter conduit having a front portion circumscribing a user's face and a back portion extending away from one side of the user's face and around the base of the user's head to a second side of the user's face; and said conduit means further including a plurality of connecting conduits operatively connected between said front and back portions of said perimeter conduit;

means defining a drain aperture in said membrane for conducting the rinsing fluid away from the user; and closure means for holding said perimeter edge closely adjacent the head of a user;

said membrane being a first membrane and each of said perimeter and connecting conduits being formed by laying a second membrane over said first membrane and selectively sealing said first and second membranes together, forming boundaries for said conduits and defining said conduits between said boundaries.

2. The device defined in claim 1 wherein said device has an interior side opposite said exterior side and further includes means defining a series of spaced apertures along each of said perimeter and connecting conduits on the interior side of said device for dispensing the rinsing fluid from said perimeter and connecting conduits to a user's hair.

3. The device defined in claim 2 wherein said device is generally partitioned into first and second halves, wherein said second membrane includes a first portion for defining said perimeter and connecting conduits embedded in said first half and a second portion for defining said perimeter and connecting conduits embedded in said second half and wherein said inlet conduit is defined between a segment of each of said first and second portions of said second membrane, said segments being selectively sealed together to form boundaries for said inlet conduit and define said inlet conduit.

4. The device defined in claim 3 wherein each of said membranes is fabricated from a plastic sheet material.

5. The device defined in claim 4 wherein said closure means is a draw cord embedded in one of said first membrane and said second membrane, closely adjacent said perimeter edge.

6. The device defined in claim 4 wherein said closure means is an elongated elastic member embedded in one of said first membrane and said second membrane, closely adjacent said perimeter edge.

7. A hair rinsing device having an exterior side, having a perimeter edge, and comprising:

a first membrane for encompassing the hair covered portion of a user's head;

a second membrane overlaying said first membrane, said first and second membranes being selectively sealed together to define a plurality of rinsing fluid chambers;

said plurality of rinsing fluid chambers for conducting a rinsing fluid to the hair for flooding the hair with the rinsing fluid;

an inlet conduit operatively connected to said rinsing fluid chambers, extending from said exterior side and having a terminal end away from said exterior side, said terminal end being adapted for operatively connecting with a faucet for supplying the rinsing fluid to said device;

means defining a drain aperture in said device for conducting the rinsing fluid away from the user; and closure means for holding said perimeter edge closely adjacent a user's head.

8. The device defined in claim 7 wherein said rinsing fluid chambers include a perimeter conduit adjacent said perimeter edge, said perimeter conduit having a front portion circumscribing a user's face and a back portion extending from one side of the user's face, away from the user's face and around the base of the user's head to the other side of the user's face, and includes a plurality of connecting conduits operatively connected with said front and back portions of said perimeter conduit.

9. The device defined in claim 8 wherein said inlet conduit is generally centered on said exterior side.

10. The device defined in claim 7 wherein said device has an interior side opposite said exterior side and further includes means defining a series of spaced apertures along each of said plurality of rinsing fluid chambers on the interior side of said device for dispensing the rinsing fluid from said perimeter and connecting conduits to a user's hair.

11. The device defined in claim 9 wherein said device is generally partitioned into first and second halves, wherein said second membrane includes a first portion for defining said perimeter and connecting conduits on said first half and a second portion for defining said perimeter and connecting conduits on said second half and wherein said inlet conduit is defined between a segment of each of said first and second portions of said second membrane, said segments being selectively sealed together for form boundaries for said inlet conduit and define said inlet conduit.

12. The device defined in claim 10 wherein said closure means is a draw cord embedded in one of said first membrane and said second membrane, closely adjacent said perimeter edge.

13. The device defined in claim 11 wherein each of said membranes is fabricated from a plastic sheet material.

* * * * *